United States Patent [19]

Bertagni

[11] 4,003,449

[45] Jan. 18, 1977

[54] PLANAR DIAPHRAGM

[76] Inventor: José Juan Bertagni, San Martin de Tours 2918 6° piso, Buenos Aires, Argentina

[22] Filed: Nov. 26, 1975

[21] Appl. No.: 635,288

[30] Foreign Application Priority Data

Nov. 28, 1974 United Kingdom ..... 51617/74

[52] U.S. Cl. ..... 181/173; 181/167; 181/174; 179/181 F

[51] Int. Cl.[2] ..... G10K 13/00; H04R 7/00

[58] Field of Search ..... 181/173, 174, 167; 179/181 R, 181 F

[56] References Cited

UNITED STATES PATENTS

| | | | |
|---|---|---|---|
| 3,464,514 | 9/1969 | Mochida et al. | 179/181 F |
| 3,718,779 | 2/1973 | Schoengold | 181/167 |
| 3,722,617 | 3/1973 | Bertagni | 181/174 |
| 3,767,005 | 10/1973 | Bertagni | 181/174 |
| 3,779,336 | 12/1973 | Bertagni | 181/174 |

*Primary Examiner*—Stephen J. Tomsky
*Attorney, Agent, or Firm*—Fleit & Jacobson

[57] ABSTRACT

A planar diaphragm, preferably for loudspeakers where, on the rear face side there is an asymmetrically shaped sound producing portion, surrounded by marginal and channel shaped portions to assure that sound waves generated by said sound producing portion will not trespass said portion, and said marginal portion is provided plugs of different density than said diaphragm, to modify the vibratory characteristic of the sound producing portion and thereby improve the response curve.

6 Claims, 5 Drawing Figures

FIG. 1
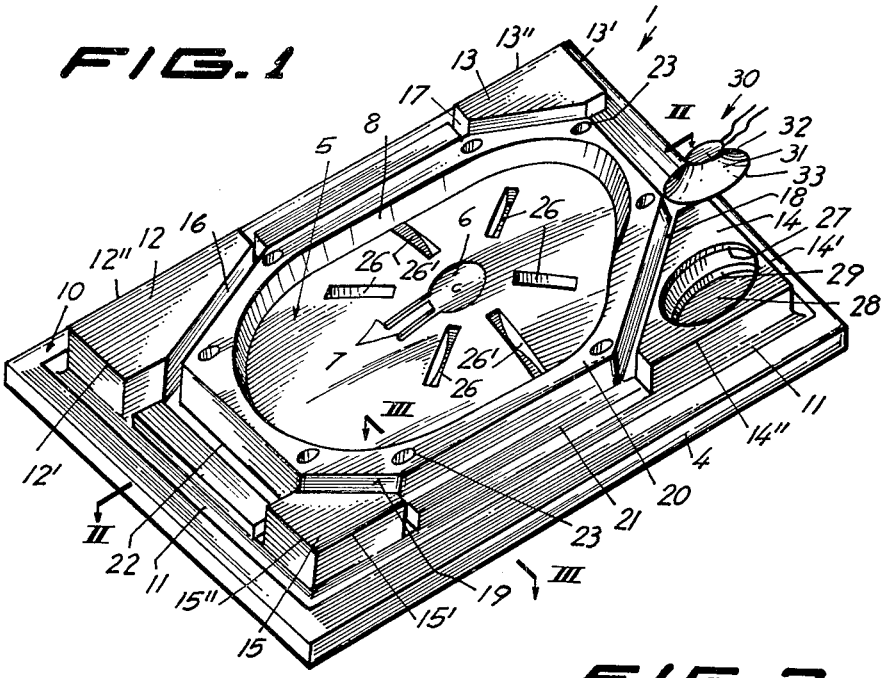
FIG. 2
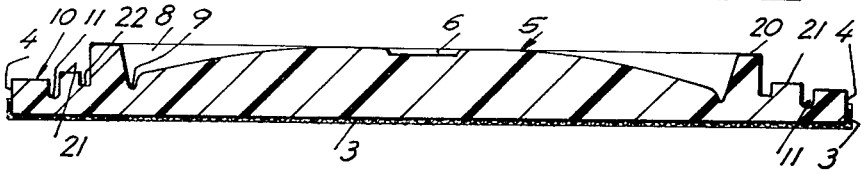
FIG. 3
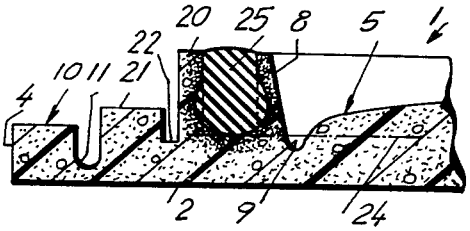
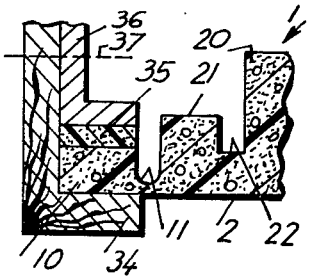
FIG. 4
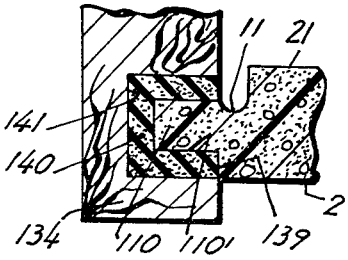
FIG. 5

PLANAR DIAPHRAGM

BACKGROUND OF THE INVENTION

This invention relates to improvements in a substantially planar diaphragm for use in an electroacoustic transducer and more particularly such diaphragm uses, in principle, the teaching of my U.S. Pat. No. 3,596,733. The diaphragm disclosed in said specification has been further developed in an effort to improve the quality of the sound when such diaphragm is used in a so called "flat loudspeaker". Test have shown that two basic concepts are important for achieving such result. One is that the vibratory movement of the sound producing sections of the diaphragm should be smooth on the active portions to avoid pronounced peaks and valleys in the response curve and the other is that the outer edge portion of the diaphragm should be so supported in a frame or casing that the active portion of the diaphragm may almost be considered as being floatingly supported.

Within these concepts several developments in different directions may be added to achieve particular results.

SUMMARY OF THE INVENTION

The invention relates, in general terms, to a substantially planar diaphragm for use in an electro-acoustic transducer, said diaphragm comprising a plate-like member made of cellular plastic material, said plate-like member having a substantially flat front face and a rear face, a marginal portion circumscribing an asymmetrically shaped portion on the rear face, said marginal portion being subdivided into an outer edge portion of less thickness —with regard to said front face— than the remainder of said marginal portion and spaced apart therefrom through an endless channel portion of still smaller thickness —will regard to said front face— than said edge portion and which endless channel portion defines a pivotal connection and a bar for the progress of vibrations which may be produced at the asymmetrically shaped portion as well as at predetermined zones of said remainder of said marginal portion, said remainder of said marginal portion being subdivided by further channelled portions to define an endless marginal portion directly surrounding said asymmetrically shaped portion and a plurality of intermediate marginal portions, said endless marginal portion having anchored therein at least one insert member of different than the density of said endless marginal portion.

BRIEF DESCRIPTION OF THE DRAWINGS

To facilitate the explanation of the different features of the invention reference will now be made to the accompanying drawings wherein:

FIG. 1 is a perspective view of the diaphragm seen from its rear face.

FIG. 2 is a section along line II—II of FIG. 1.

FIG. 3 is a section along line III—III of FIG. 1.

FIG. 4 is a detail in cross section showing one way of supporting the outer edge portion of the diaphragm.

FIG. 5 is a detail in cross section showing another way of supporting a slightly modified outer edge portion of the diaphragm.

DESCRIPTION OF THE PREFERRED EMBODIMENT

The planar diaphragm 1 is a plate-like member made of cellular plastics material and has a flat front face 2 which may be sheathed (as only shown in FIG. 2) with a fabric 3, which usually covers at least part of the side faces 4. The rear face comprises in its central zone, an asymmetrically shaped portion 5 having preferably a central recess 6 which is out of the geometrical center of said asymmetrically shaped portion 5 and to which a voice coil forming part of a electromagnetic assembly, not shown, is to be connected, as already explained in my U.S. Pat. No. 3,801,943. Conveniently the central recess 6 is connected to a pair of channels 7 to house therein the outcoming conductors (not shown) of the above referred to electromagnetic assembly. A marginal portion circumscribes said asymmetrically shaped portion 5 on said rear face and said marginal portion is subdivided into different portions as will be later explained.

The asymmetrically shaped portion 5 represents the active portion of the diaphragm, at least for the low frequency and medium frequency ranges. The general concept of the planar diaphragm is that the vibrations generated at the central recess 6 do not move beyond the side wall 8 and conveniently such side wall continues into an endless channel member 9 to thereby achieve a better bar against the progress of the vibrations into the marginal portion. The concept of such endless channel member 9 is already fully disclosed in my U.S. Pat. No. 3,722,617.

The marginal portion of the plate-like member circumscribing the asymmetrically shaped portion of the planar diaphragm 1 is subdivided into different zones and more particularly into an outer edge portion 10 including said side faces 4 and which is of less thickness than the remainder of the marginal portion and spaced apart therefrom through an endless channel portion 11 of still smaller thickness than said edge portion 10. The endless channel portion 11 defines a pivotal connection with the remainder of said marginal portion which circumscribes the asymmetrically shaped portion 5 and the purpose of the purpose of which will be later explained.

The above referred to remainder of said marginal portion is subdivided by further channel portions, thus forming four corner portions 12, 13, 14 and 15, each of which has a pentagonal cross-sectional surface, having two sides 12', 12'', 13', 13'', 14', 14'', 15', 15'' at right angles and forming the respective corners with regard to the endless channel portion 11. The other three sides are separate from the remainder of the marginal portion, by a pertinent channel 16, 17, 18, 19 respectively, ending into said channel portion 11, to thereby separate the corner portions 12 to 15 from an endless marginal portion 20 which includes the side wall 8 and which directly surrounds said asymmetrically shaped portion 5.

Between pairs of the corner portions 12 to 15, there are projecting reinforcing rib members 21 of preferably smaller height than said corner portions 12 to 15, but of larger height than said outer edge portion 10. The reinforcing members 21 are spaced apart from said endless marginal portion 20 by channel portions 22 which together with the channels 16 to 19 form an endless channel member.

Upon testing a diaphragm to determine its sound response curve, the latter may show certain peaks and valleys which are undesirable or it may be desired to enhance the sensibility of a certain frequency range for particular purposes. To this end according to the invention such changes may be obtained by anchoring additional weights in the endless marginal portion 20. This may be achieved in different ways.

A first possibility could be to mould the diaphragm as shown in FIG. 1 with suitably distributed blind perforations 23 along the endless marginal portion. The bottom of each blind perforation should be approximately in a plane 24 (FIG. 3) which passes through the periphery of the asymmetrically shaped portion as indicated in FIG. 3. Within these blind perforations 23, plug 25 may be housed having either a larger or a smaller density than the density of the material of which the diaphragm is made. Preferably these plugs 25 are pressure injected into the blind perforation so that adjacent the bottom portion of said perforation each plug 25 distends and becomes thereby anchored in the endless marginal portion 20 and the wall portion surrounding each plug 25 becomes thereby compressed and increases its density, to thus still better retain the pertinent plug.

Another possible alternative could be to provide the endless marginal portion 20 with an endless slot into which the additional weight members may be anchored at any suitable position.

A further possible alternative could be to inject by means of an injection pistol (not shown) weight members without previously forming either a blind bore or a slot, if the material of the diaphragm is sufficiently soft.

Instead of using a pistol, rigid metal members could just be inserted.

Bearing in mind that the central recess 6 is connected to the voice coil (not shown) and that the asymmetrically shaped portion 5 is the one to vibrate, the endless marginal portion has to be considered as being a semiactive portion with regard to the remainder of the marginal portion formed by the corner portions 12 to 15, reinforcing rib members 22 and the outer edge portion 10. It will be readily understood by those skilled in the art that the insert of such weight members 25 will change the vibratory behaviour of the asymmetrically shaped portion 5. For instance, if at a certain frequency the pressure curve shows a peak, upon insertion of the weight at the proper place, which is empirically determined, such peak may be moved with regard to the frequency range so that such peak overlaps a valley in the frequency curve, whereby the sum of both produces a leveling of the curve. Further tests have shown that if the plugs 25 are made of a resilient material, excellent results are obtained.

When the asymmetrically shaped portion 5 starts to vibrate in a particular section, depending on the frequency range transmitted, the granules forming this portion of the diaphragm tend to expand and contract and thereby alternating granule expanding and compressing forces are generated in the entire diaphragm and this should be avoided. To this end the radial slots 26 are provided in the asymmetrically shaped portions 5 whereby the granular mass can expand into the spaces defined by said slots.

Slots 26' differ from slot 26 in that they reach to the endless channel member 9 and if desired a metal foil may be housed therein to achieve particular sound effects as already described in my U.S. Pat. No. 3,722,617. The radial slots 26, 26' improve the lower frequency ranges and increased the range extension of the response curve at the lower frequency range and also increase the level of the response curve in particular in the medium frequencies.

Turning now to the corner portions 12 to 15, each one may be a diaphragm for a tweeter. Corner portion 14, is an example of a tweeter arrangement; it may be seen that the former includes a circular pit formed by the side wall 27 and the bottom wall 28, in between which there is a step-like rim 29. The bottom wall 28 has a thickness slightly larger than the outer edge portion 10 and acts as a diaphragm of a tweeter. Since the corner portion 14 is completely surrounded by the channel 18 and 11, the vibrations generated by the tweeter arrangement 30 will not exert any influence on the asymmetrically shaped portion. Piezoelectric direct radialing tweeter arrangements have been proposed in the 42nd Convention of May 2–5, 1972 of the Audio Engineering Society in New York, U.S.A. by Hugh Schafft, of Motorola, Inc., Franklin Park, Ill. This tweeter arrangements 30 includes a cone 31 and a piezoelectric drive 32 as shown in FIG. 1, but in addition the peripherical rim 33 of the cone 31 in those known tweeter arrangements are housed in an aluminium mounting cap, so that they transmit sound only in one direction. According to a further feature of the present invention this aluminium mounting cap is removed and the peripherical rim 33 is mounted onto the step-like rim 29, which rim acts as a damping washer. If desired, a separate semirigid polyurethane washer may be interposed. Such tweeter increases the high frequency range in the response curve and also increases the pressure on the diaphragm, in particular at the lower end of the medium frequency range. Furthermore since no rigid mounting cap exists, the tweeter transmits sound in two opposite directions.

As already explained, the channels 18 and portion of channel 11 which surrounds the corner portion 14, assure that the vibrations generated by the tweeter arrangement will not detrimentally influence other zones of the diaphragm. To further enhance this requirement the already described reinforcing rib members 21 are provided. If desired rubber sponge strips (not shown) may be mounted on the top surface of each of said rib members 21 in order to provide an additional damping arrangement.

From the foregoing it will be understood that different types of vibrations may be simultaneously generated in the asymmetrically shaped portion 5 and bottom wall 28. Theoretically the best arrangement would be to support these portions 5, 28 in the air, so that each portion would operate in a complete independent way. In practice this is of course not possible and therefore the planar diaphragm, according to the invention, must be supported in the best possible way to obtain, so to say, the floating feature. To this end the marginal edge portion is divided into a number of sections through the channels 16 to 19. Endless channel portion 11 surrounds the divided marginal portion and separates therefrom the outer edge portion 10. The outer edge portion 10 is the one to be supported for instance in a casing 34 (FIG. 4) and the endless channel portion 11 acts as a hinge to thereby provide a pivotal connection which approaches the "floating effect". On the outer edge portion 10 a resilient damping washer 35 is arranged and further connected for instance to an aluminium frame 36 connected by means of screws, as schematically indicated by axis 37, to the casing 34.

In the embodiment shown in FIG. 5, the outer edge portion 110 has a front face 110′ which is connected through a step 139 to the flat front face 2, which enables to provide a U-shaped cushion member 140 around the outer edge portion 110 and fit the assembly directly into a U-shaped channel 141 of a casing 134. In this arrangement the frame 36 of FIG. 4 becomes superfluous and this diaphragm provides a better response in the low frequency range and increases the range extension at both ends of the response curve.

It will be understood that improvements may be introduced into the embodiments described by way of example and modifications may be made in the constructions and material employed without departing from the scope of the invention.

I claim:

1. In a substantially planar diaphragm for use in an electro-acoustic transducer, a plate-like member made of cellular plastics material, said plate-like member having a substantially flat front face and a rear face, a marginal portion circumscribing an asymmetrically shaped portion on the rear face, said marginal portion being subdivided into an outer edge portion of less thickness —with regard to said front face— than the remainder of said marginal portion and spaced apart therefrom through an endless channel portion of still smaller thickness —with regard to said front face— than said edge portion and which endless channel portion defines a pivotal connection and a bar for the progress of vibrations which may be produced at the asymmetrically shaped portion as well as at predetermined zones of said remainder of said marginal portion, said remainder of said marginal portion being subdivided by further channelled portions to define an endless marginal portion directly surrounding said asymmetrically shaped portion and a plurality of intermediate marginal portions, said endless marginal portion having anchored therein at least one insert member of different density than the density of said endless marginal portion.

2. The substantially planar diaphragm as claimed in claim 1, wherein said asymmetrically shaped portion has radial slots.

3. The substantially planar diaphragm as claimed in claim 1, wherein said endless marginal portion has spaced apart blind perforations into which plugs may be so pressure fit, that the portion of the plug adjacent the bottom of the blind perforation becomes distended and thereby the plug anchored in said endless marginal portion.

4. The substantially planar diaphragm as claimed in claim 1, wherein said remainder of said marginal portion is separated from said endless marginal portion by channels.

5. The substantially planar diaphragm as claimed in claim 4, wherein said remainder of said marginal portion in the zone out of said endless marginal portion is subdivided by channels into corner portions and intermediate reinforcing rib members, at least one of said corner portions defines a pit having a bottom wall and a side wall interconnected by a step-like rim supporting the outer peripheral edge of a cone of a piezoelectric driver defining a tweeter arrangement.

6. The substantially planar diaphragm as claimed in claim 1, wherein said outer edge portion has a front face located in a different plane than said substantially flat front face and said outer edge portion being surrounded by a U-shaped cushion member.

* * * * *